US009389579B2

(12) United States Patent
Nishiyama

(10) Patent No.: US 9,389,579 B2
(45) Date of Patent: Jul. 12, 2016

(54) IMAGE FORMING APPARATUS HAVING A REMOVABLE MOUNTED DEVELOPING CARTRIDGE

(71) Applicant: BROTHER KOGYO KABUSHIKI KAISHA, Nagoya-shi, Aichi-ken (JP)

(72) Inventor: Hideshi Nishiyama, Owariasahi (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 14/663,636

(22) Filed: Mar. 20, 2015

(65) Prior Publication Data

US 2015/0277361 A1 Oct. 1, 2015

(30) Foreign Application Priority Data

Mar. 31, 2014 (JP) ..... 2014-074683

(51) Int. Cl.
*G03G 21/16* (2006.01)
*G03G 21/18* (2006.01)

(52) U.S. Cl.
CPC ..... *G03G 21/1676* (2013.01); *G03G 21/1633* (2013.01); *G03G 21/1647* (2013.01); *G03G 21/1842* (2013.01); *G03G 2221/169* (2013.01)

(58) Field of Classification Search
CPC ..... G03G 21/1676; G03G 21/1842; G03G 21/1814
See application file for complete search history.

(56) References Cited

U.S. PATENT DOCUMENTS

| | | | | |
|---|---|---|---|---|
| 8,606,141 | B2 | 12/2013 | Furuya et al. | |
| 2010/0239312 | A1* | 9/2010 | Kikuchi | G03G 21/1821 399/111 |
| 2011/0305480 | A1* | 12/2011 | Tanaami | G03G 15/0147 399/112 |
| 2013/0259520 | A1* | 10/2013 | Miwa | G03G 21/1633 399/110 |
| 2015/0050042 | A1* | 2/2015 | Sato | G03G 21/1842 399/110 |
| 2015/0050045 | A1* | 2/2015 | Sato | G03G 21/1842 399/111 |
| 2015/0125178 | A1* | 5/2015 | Sakuma et al. | 399/111 |

FOREIGN PATENT DOCUMENTS

| | | | |
|---|---|---|---|
| JP | 2006-091284 | A | 4/2006 |
| JP | 2011-227457 | A | 11/2011 |
| JP | 2014-016484 | A | 1/2014 |

* cited by examiner

*Primary Examiner* — Francis Gray
(74) *Attorney, Agent, or Firm* — Merchant & Gould P.C.

(57) ABSTRACT

There is provided an image forming apparatus including a main body, a cover, a photosensitive body cartridge, and a developing cartridge. The main body includes a supporting portion and the developing cartridge includes a supported portion. The supporting portion and the supported portion are configured such that the developing cartridge is pivotable relative to the main body about a third axis, which is parallel to a first axis and is separate from a second axis, between a first position, in which the developer carrier is away from the photosensitive body, and a second position, in which developer carrier is close to the photosensitive body. The cover includes a pressing member configured to press the developing cartridge in a direction perpendicular to the third axis such that the developer cartridge pivots from the first position to the second position.

24 Claims, 10 Drawing Sheets

IMAGE FORMING APPARATUS HAVING A REMOVABLE MOUNTED DEVELOPING CARTRIDGE

CROSS-REFERENCE TO RELATED APPLICATION

This application claims priority from Japanese Patent Application No. 2014-074683 filed on Mar. 31, 2014, the content of which is incorporated herein by reference in its entirety.

TECHNICAL FIELD

Aspects described herein relate to an electrophotographic image forming apparatus and, more particularly, to an image forming apparatus including a developing cartridge configured to be removably mounted to a main body of the apparatus.

BACKGROUND

A known image forming apparatus includes a developing cartridge configured to be removably mounted to a main body of the apparatus. An image forming apparatus of this kind includes a process cartridge that includes a photosensitive body cartridge configured to be removably mounted to a main body of the apparatus and a developing cartridge configured to be removably mounted to the photosensitive body cartridge.

The photosensitive body cartridge includes a photosensitive body, e.g., a photosensitive drum, configured to have developer supplied thereto. The developing cartridge includes a developer carrier, e.g., a developing roller, configured to supply developer to the photosensitive drum. The main body has an opening that opens upward to allow the process cartridge having the developing cartridge mounted to the photosensitive body cartridge to be removably mounted to the main body.

SUMMARY

In the known image forming apparatus, to press the developing roller toward the photosensitive body, for example, the photosensitive body cartridge includes a pressing member configured to press the developing roller. The pressing member is configured to press the developing cartridge with the developing cartridge mounted to the photosensitive body cartridge.

When the developing cartridge is mounted to the photosensitive body cartridge mounted in the main body, the developing cartridge receives resistance of pressing force generated by the pressing member of the photosensitive body cartridge. In this case, an operation of mounting the developing cartridge to the photosensitive body cartridge may have some troubles.

According to one or more aspects of the disclosure, an image forming apparatus may include a main body, a cover, a photosensitive body cartridge, and a developing cartridge. The main body may have an opening. The cover may be configured to open and close the opening. The photosensitive body cartridge may include a photosensitive body configured to rotate about a first axis. The developing cartridge may include a developer carrier configured to rotate about a second axis parallel to the first axis and to supply developer to the photosensitive body. The main body may be configured to receive the developing cartridge through the opening in a direction perpendicular to the first axis. The main body may include a supporting portion and the developing cartridge may include a supported portion. The supporting portion and the supported portion may be configured such that the developing cartridge is pivotable relative to the main body about a third axis, which is parallel to the first axis and is separate from the second axis, between a first position, in which the developer carrier is away from the photosensitive body, and a second position, in which developer carrier is close to the photosensitive body. The cover may include a pressing member configured to press the developing cartridge in a direction perpendicular to the third axis such that the developer cartridge pivots from the first position to the second position.

DETAILED DESCRIPTION

Figure 1:
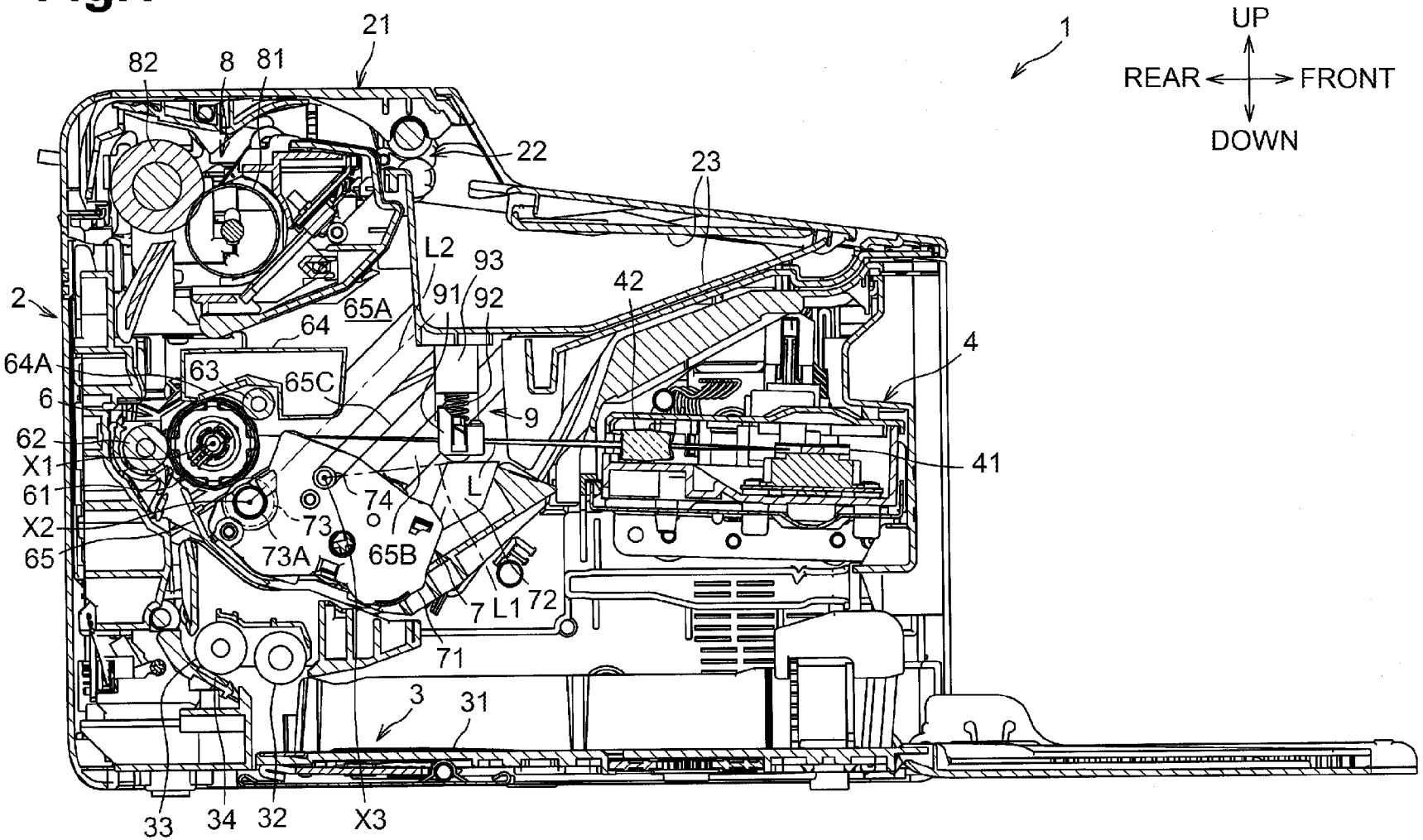
FIG. 1 is a side sectional view of a laser printer as an example of image forming apparatus in an illustrative embodiment according to one or more aspects of the disclosure, illustrating a general structure of the laser printer with a top cover thereof closed.

An illustrative embodiment will be described with reference to the accompanying drawings. An image forming apparatus according to an illustrative embodiment may be, for example, a laser printer 1, as shown in FIG. 1. Referring to FIG. 1, general structure of the laser printer 1 will be described.

Hereinafter, description will be made with reference to directions that are defined in conjunction with an orientation in which a user uses the laser printer 1. For example, right and left sides of FIG. 1 are defined as front/forward and rear/back sides, respectively. The top-bottom direction in FIG. 1 is defined as the vertical direction. The front and back sides of the sheet of FIG. 1 are defined as left and right sides, respectively.

<General Structure of Laser Printer>

Figure 2:
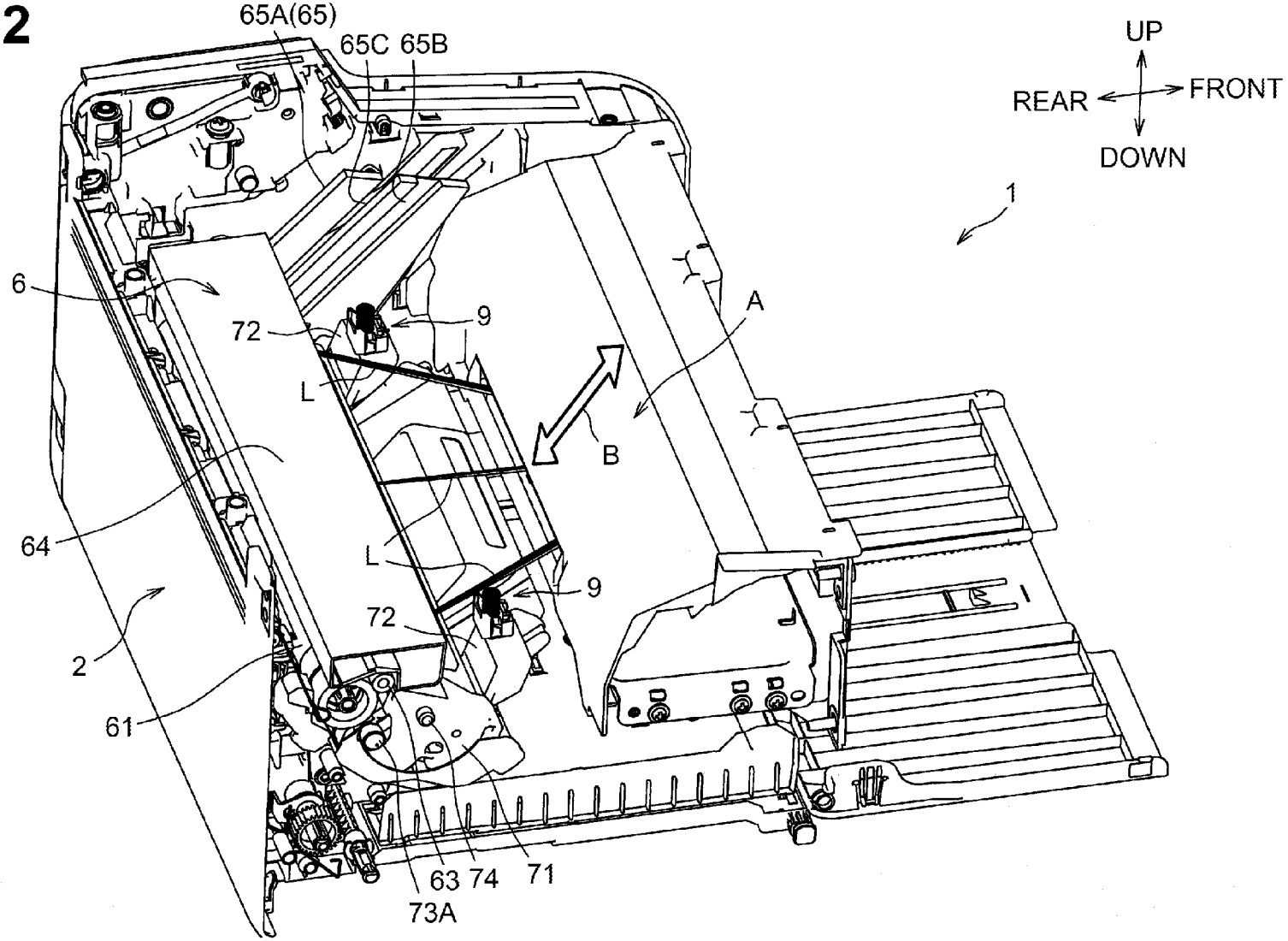
FIG. 2 is a perspective view of the laser printer illustrating a general structure thereof with the top cover omitted.

As depicted in FIG. 1, the laser printer 1 includes a main body, e.g., a main casing 2. The main casing 2 includes a cover, e.g., a top cover 21, that covers an upper portion of the main casing 2. A rear end portion of the top cover 21 is pivotally supported at an upper rear portion of the main casing 2. As the top cover 21 is pivotally moved upward and rearward (refer to FIG. 4), an opening A provided at an upper portion of the main casing 2 is exposed, as depicted in FIG. 2.

The laser printer 1 mainly includes, in the main casing 2, a sheet feed unit 3 configured to feed a recording sheet, e.g. a sheet, an exposure device, e.g., a scanner unit 4, a photosensitive body cartridge 6 and a developing cartridge 7 for transferring a toner image (e.g., a developer image) onto a sheet, and a fixing unit 8 configured to thermally fix the toner image transferred onto the sheet. In the laser□printer 1, the sheet feed unit 3 is disposed at a lower portion of the main casing 2. The photosensitive body cartridge 6 is disposed at a rear portion of the main casing 2. The fixing unit 8 is an example of a fixing portion. The fixing unit 8 is disposed above the photosensitive body cartridge 6. With such structure, the laser printer 1 defines a generally C-shaped feeding path in the main casing 2.

The sheet feed unit 3 is disposed at a lower portion of the main casing 2. The sheet feed unit 3 includes a sheet tray 31 configured to hold sheets, and a pickup roller 32, a separation roller 33, and a separation pad 34 for feeding the sheets.

A sheet held in the sheet tray 31 is fed upward in a rear portion of the main casing 2, while curving, by the pickup roller 32, the separation roller 33, and the separation pad 34. The sheet is fed between a photosensitive body, e.g., a photosensitive drum 61, of the photosensitive body cartridge 6 and a transfer roller 62.

The scanner unit 4 is disposed in a front half portion of the main casing 2 at a central portion thereof in the top-bottom or vertical direction. The scanner unit 4 includes a laser emitting section (not depicted), a polygon mirror 41, a reflecting mirror (not depicted), and a lens 42. The scanner unit 4 is configured to scan at high speed across a peripheral surface of the photosensitive drum 61 with laser beam L emitted from the laser emitting section based on image data through the lens 42. Thus, the surface of the photosensitive drum 61 is exposed to the laser beam L.

The photosensitive body cartridge 6 is disposed in a rear portion of the main casing 2 at a central portion thereof in the top-bottom direction behind the scanner unit 4. The photosensitive body cartridge 6 mainly includes the photosensitive drum 61 configured to have toner (e.g., developer) supplied from the developing cartridge 7, the transfer roller 62 configured to feed a sheet by holding the sheet between the transfer roller 62 and the photosensitive drum 61, a charging roller 63 configured to charge the peripheral surface of the photosensitive drum 61 in advance, a waste developer container 64 configured to contain toner (e.g., developer) collected from the peripheral surface of the photosensitive drum 61, and a photosensitive body frame 65 supporting those components 61, 62, 63, and 64.

The transfer roller 62 is disposed behind the photosensitive drum 61. The charging roller 63 is disposed diagonally above and to the front of the photosensitive drum 61. The waste developer container 64 is disposed above the photosensitive drum 61, covering the charging roller 63. As depicted in FIG. 2, the waste developer container 64 has a flat box shape elongated in an axial direction of the photosensitive drum 61. A rear half portion of the waste developer container 64 is disposed above the photosensitive drum 61 and a front half portion of the waste developer container 64 is disposed above the developing cartridge 7.

The waste developer container 64 includes a cleaning blade 64A configured to collect toner by making contact with a surface of the photosensitive drum 61 and to contain the toner collected from the photosensitive drum 61 by the cleaning blade 64A. The cleaning blade 64A extends along the axial direction of the photosensitive drum 61.

With the opening A at an upper portion of in the main casing 2 exposed as depicted FIG. 2, the developing cartridge 7 is pushed or inserted diagonally downward and to the rear through the opening A along an insertion/removal path B. Accordingly, the developing cartridge 7 is mounted to a mounted position diagonally below and to the front of the photosensitive drum 61 in the main casing 2, as depicted in FIG. 1. The developing cartridge 7 is pulled or removed diagonally upward and to the front from the mounted position along the insertion/removal path B, as depicted in FIG. 2. Thus, the developing cartridge 7 is removed outside the main casing 2 through the opening A of the main casing 2.

Figure 3:
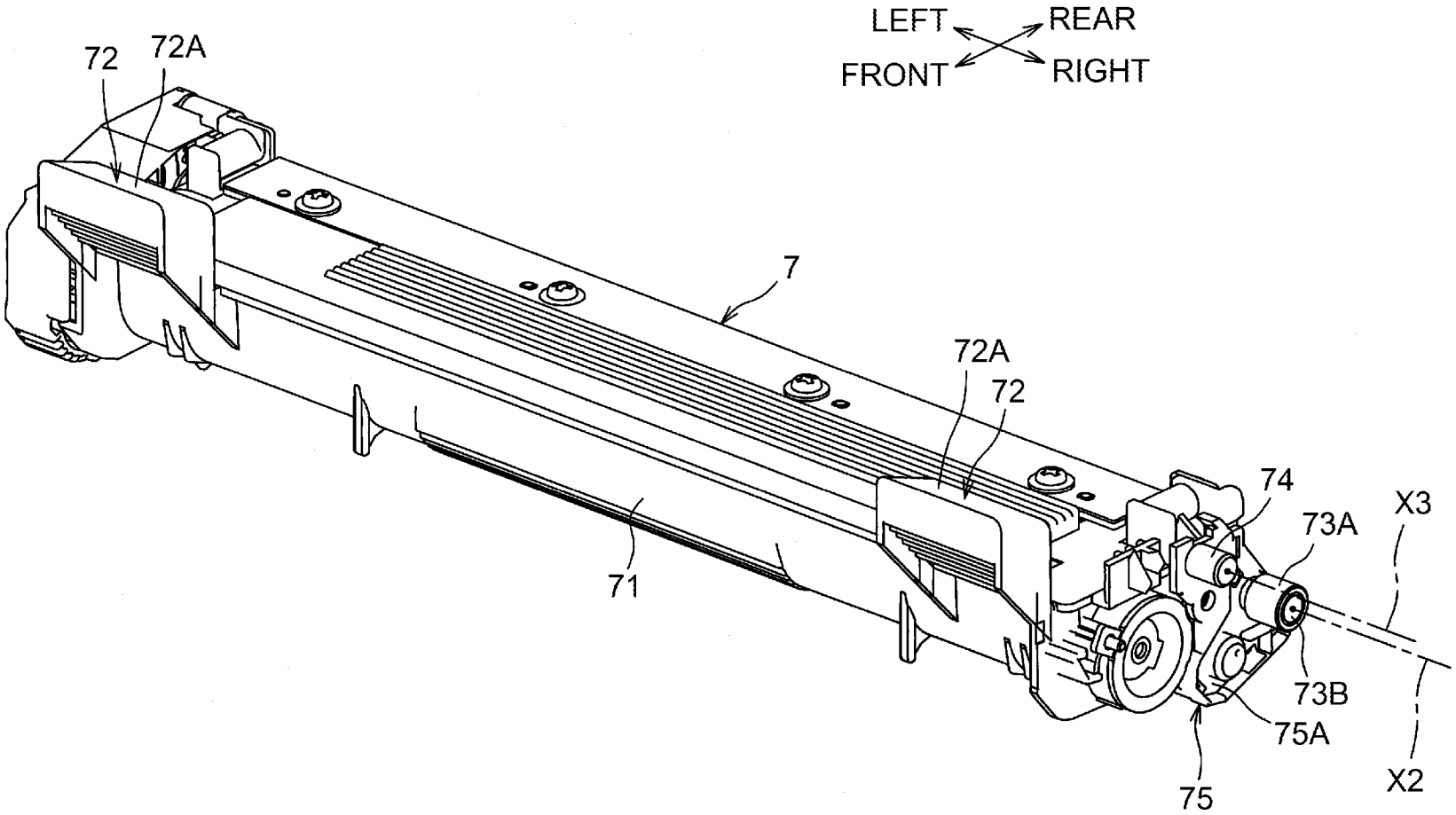
FIG. 3 is a perspective view of a developing cartridge of the laser printer depicted in FIG. 1 when viewed from the front side indicated in FIG. 1, illustrating a general structure of the developing cartridge.

As depicted in FIG. 3, the developing cartridge 7 includes a developing frame 71, which is a casing elongated in the right-left direction. The developing frame 71 includes holding portions, e.g. left and right grips 72 and 72, at front portions thereof. The grips 72 and 72 are configured to be held when the developing frame 71 is mounted or removed. A developer carrier, e.g., a developing roller 73, is rotatably supported at a rear portion of the developing frame 71 (refer to FIG. 1).

The developing cartridge 7 includes the developing frame 71, a supply roller (not depicted) configured to supply toner to a peripheral surface of the developing roller 73, a layer thickness regulating blade (not depicted) configured to regulate the thickness of a layer of toner supplied from the supply roller to the peripheral surface of the developing roller 73, and an agitator configured to agitate toner. The developing frame 71 includes a toner chamber configured to contain toner therein. The agitator is configured to agitate the toner in the toner chamber.

In the photosensitive body cartridge 6 as depicted in FIG. 1, the charging roller 63 uniformly changes the peripheral surface of the photosensitive drum 61. Thereafter, the peripheral surface of the photosensitive drum 61 is subjected to high speed scan of the laser beam L from the scanner unit 4, so that an electrostatic latent image is formed on the peripheral surface of the photosensitive drum 61 based on image data.

In the developing cartridge 7, toner is supplied to a peripheral surface of the supply roller while the toner in the toner chamber is agitated by the agitator. Then, the toner is supplied from the peripheral surface of the supply roller to the peripheral surface of the developing roller 73. The toner enters between the peripheral surface of the developing roller 73 and the layer thickness regulating blade. The toner is carried on the peripheral surface of the developing roller 73 as a thin layer having a uniform thickness.

The photosensitive drum 61 has a rotation axis of a first axis X1. The developing roller 73 has a rotation axis of a second axis X2. The first axis X1 and the second axis X2 are parallel to each other. Therefore, as the photosensitive drum 61 and the developing roller 73 rotates, toner carried on the peripheral surface of the developing roller 73 is supplied to an electrostatic latent image formed the peripheral surface of the photosensitive drum 61. Thus, the electrostatic latent image is developed into a visible toner image and the toner image is formed on the peripheral surface of the photosensitive drum 61. Thereafter, as a sheet is fed between the photosensitive drum 61 and the transfer roller 62, the toner image on the peripheral surface of the photosensitive drum 61 is transferred onto the sheet.

The sheet having the toner image transferred thereon from the peripheral surface of the photosensitive drum 61 is fed toward the fixing unit 8 through a portion between the photosensitive drum 61 and the transfer roller 62. The fixing unit 8 is disposed above the photosensitive body cartridge 6. The fixing unit 8 includes a heat roller 81 and a pressure roller 82 configured to feed a sheet while holding the sheet therebetween. The pressure roller 82 is configured to apply pressure to a sheet while holding the sheet with the heat roller 81. The heat roller 81 is configured to apply heat to a sheet with a heat source, e.g., a halogen lamp, contained therein.

As a sheet passes between the heat roller 81 and the pressure roller 82 of the fixing unit 8, the toner image transferred onto the sheet is thermally fixed onto the sheet. Thereafter, the sheet having the toner image thermally fixed thereon is fed from an upper rear side of the main casing 2 to the front while curving, by the rotation of the heat roller 81 and the pressure roller 82. The sheet is discharged by discharge rollers 22 onto a discharge tray 23 formed on the top cover 21. The discharge tray 23 includes an extension tray, which is folded in FIG. 1.

<Structure of Developing Cartridge>

Next, structures of the developing cartridge 7 will be described referring to the accompanying drawings. As depicted in FIG. 3, the developing cartridge 7 includes the developing frame 71, which is a casing elongated in the right-left direction, and bearings 75 disposed at rear end portions of the developing frame 71.

The developing frame 71 includes the holding portions, e.g., the left and right grips 72 and 72, that are held when the developing cartridge 7 is mounted or removed. Each of the grips 72 and 72 is an example of a pressed portion. Each of the grips 72 and 72 is positioned on a front portion of the developing frame 71. Each of the grips 72 and 72 protrudes upward. The grips 72 and 72 are integrally formed with the developing frame 71. Each of the grips 72 and 72 includes a pressed surface 72A that is pressed by a corresponding pressing member 9 (described below) when the developing cartridge 7 is mounted in the main casing 2. The pressed surface 72A is a plane extending along a horizontal direction (e.g., the front-rear direction and the right-left direction) when the developing cartridge 7 is mounted in the main casing 2.

Each of the bearings 75 includes a main portion 75A, a protrusion, e.g., a shaft supporting portion 73A, that supports a rotation shaft 73B of the developing roller 73, and a boss portion 74.

The main portion 75A is a plate-like member. The main portion 75A is fixed to a side surface of the developing frame 71. The shaft supporting portion 73A has a shape of a cylinder with its center being the second axis X2 of the developing roller 73. The shaft supporting portion 73A protrudes from the main portion 75A outward (e.g., in a direction away from the center of the developing cartridge 7 in the left-right direction). The shaft supporting portion 73A covers a portion of an outer peripheral surface of the rotation shaft 73B of the developing roller 73. The shaft supporting portion 73A is integrally formed with the main portion 75A. The boss portion 74 has a shape of a cylinder with its center being a third axis X3 parallel to the first axis X1. The boss portion 74 protrudes from the main portion 75A outward (e.g., in a direction away from the center of the developing cartridge 7 in the left-right direction). The boss portion 74 is integrally formed with the main portion 75A.

Each of the main portion 75A, the shaft supporting portion 73A, and the boss portion 74 includes conductive resin. The boss portion 74 is configured to contact a casing electrode TP disposed in the main casing 2 and serves as a contact for applying developing bias to the developing roller 73.

<Guiding Structure for Developing Cartridge>

Next, a guiding structure for the developing cartridge 7 will be described referring to the accompanying drawings. As depicted in FIG. 2, the photosensitive body frame 65 of the photosensitive body cartridge 6 includes guide plates 65A, each extending along an inner surface of a corresponding side wall of the main casing 2. In FIG. 2, the left guide plate 65A is omitted. The guide plates 65A support, at respective rear end portions thereof, the photosensitive drum 61, the charging roller 63, the transfer roller 62, and the waste developer container 64.

Figure 4:
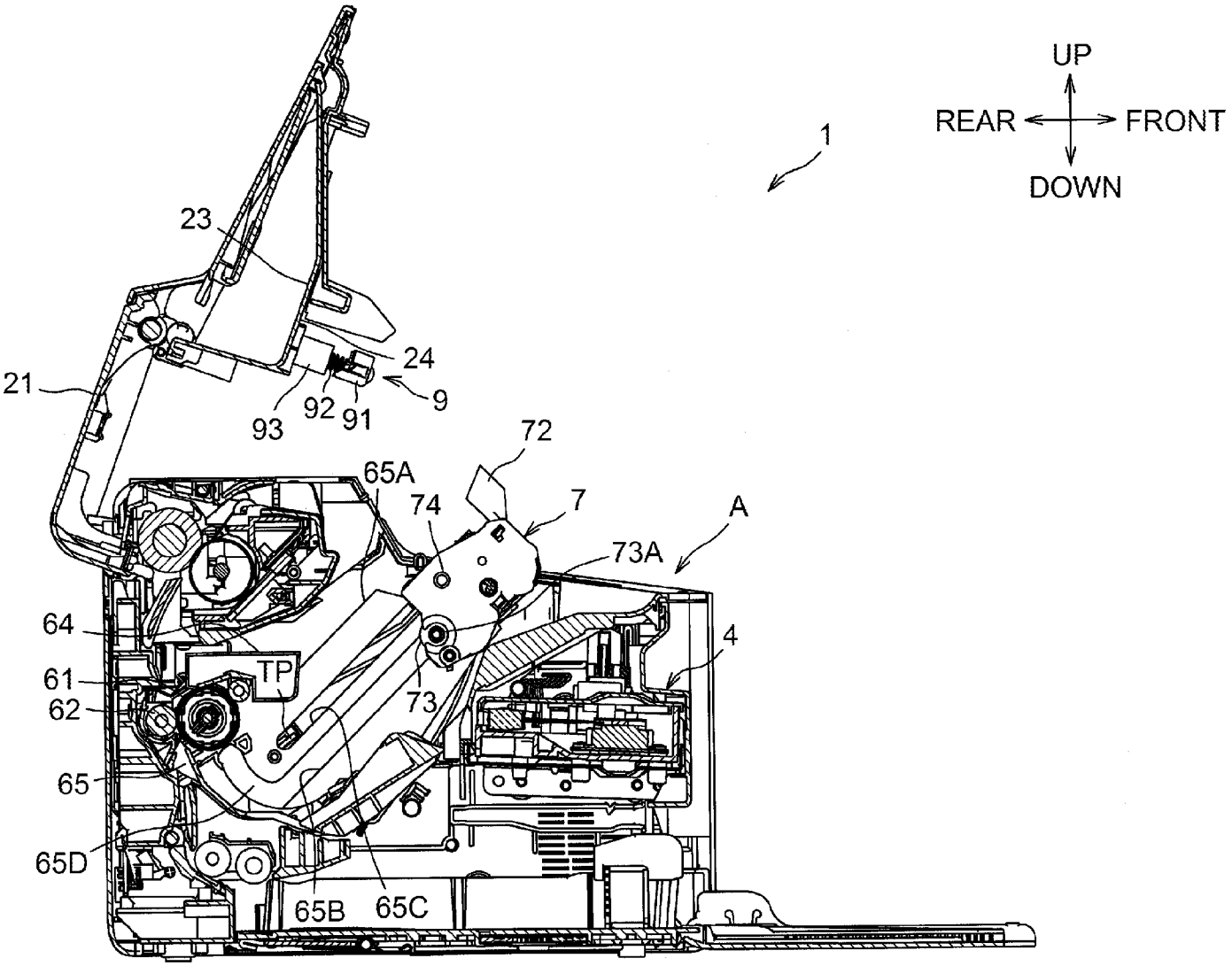
FIG. 4 is a side sectional view of the laser printer when the developing cartridge is in a removed position at an upper front portion of an insertion/removal path.
Figure 8:
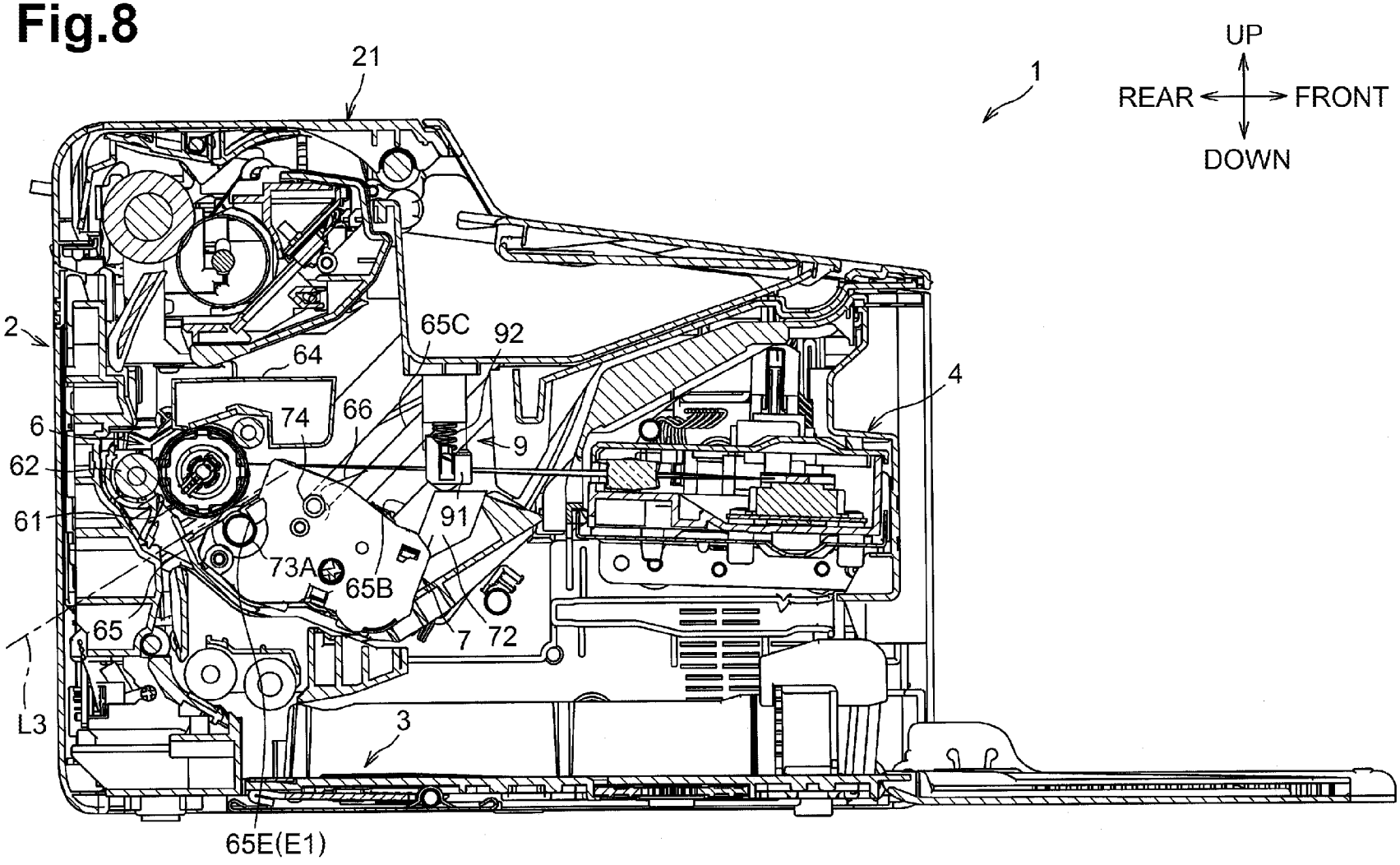
FIG. 8 is a side sectional view of a first modification of the laser printer depicted in FIG. 1, illustrating a general structure of the modified laser printer with a top cover thereof closed.

As depicted in FIG. 4, each guide plate 65A includes a shaft guide 65B, a guide portion 65C, a pivotal guide 65D, and a regulating portion 65E (refer to FIG. 8). The shaft guide 65B and the guide portion 65C extend along the insertion/removal path B perpendicular to the first axis X1.

Each shaft guide 65B has a groove configured to guide a corresponding shaft supporting portion 73A. Thus, the shaft guides 65B guide the rotation shaft 73B of the developing roller 73. Each pivotal guide 65D extends diagonally upward and to the rear from a lower portion of a corresponding shaft guide 65B while curving like an arc. Each pivotal guide 65D has a shape of an arc of a circle with its center being a lower end portion of a corresponding guide portion 65C.

As depicted in FIG. 8, each regulating portion 65E has a block shape protruding inward (e.g., in a direction toward the center of the photosensitive body frame 65 in the left-right direction) from an inner surface of a corresponding guide plate 65A along the right-left direction. Each regulating portion 65E is disposed adjacent to an upper end portion of a corresponding pivotal guide 65D. Each regulating portion 65E includes a regulating surface E1 that contacts a corresponding shaft supporting portion 73A when the developing cartridge 7 is mounted on the photosensitive body cartridge 6. In other words, each regulating surface E1 is configured to contact the rotation shaft 73B of the developing roller 73, via a corresponding shaft supporting portion 73A. The regulating surface E1 is substantially perpendicular to a common tangent L3 of the photosensitive drum 61 and the developing roller 73.

As depicted in FIG. 4, each guide portion 65C has a slit configured to guide a corresponding boss portion 74 while receiving the corresponding one of the boss portions 74. An end face of each boss portion 74 is exposed from a corresponding guide portion 65C when the developing cartridge 7 is mounted on the photosensitive body cartridge 6. Therefore, the boss portion 74 may contact the casing electrode TP disposed in the main casing 2. Each boss portion 74 constitutes a supported portion configured to be supported by the main casing 2 to allow the developing cartridge 7 to pivotally move relative to the main casing 2, via a corresponding guide portion 65C (e.g., the photosensitive body frame 65). Each guide portion 65C is configured to pivotally support, at a lower end portion thereof, a corresponding boss portion 74. Each guide portion 65C is configured to guide a corresponding boss portion 74 toward a lower end portion thereof from a position above the photosensitive body cartridge 6. The lower end portion of the guide portion 65C is located at a supporting position in which the corresponding boss portion 74 is supported such that the developing cartridge 7 pivots about the boss portion 74.

The insertion/removal path B as depicted in FIG. 2 extends in a direction perpendicular to the first axis X1, which is a rotation axis of the photosensitive drum 61. The shaft guides 65B and the guide portions 65C function as a guiding structure for pushing or inserting the developing cartridge 7 diagonally downward and to the rear along the insertion/removal path B through the opening A of the main casing 2. The shaft guides 65B and the guide portions 65C also function as a guiding structure for pulling or removing the developing cartridge 7 diagonally upward and to the front along the insertion/removal path B through the opening A.

When each boss portion 74 is in the lower end of a corresponding guide portion 65, the developing cartridge 7 pivots about the third axis X3 connecting the right and left boss portions 74 as each shaft supporting portion 73A is guided by a corresponding pivotal guide 65D. In other words, as the developing cartridge 7 pivots about the third axis X3, which is parallel to the first axis X1 of the photosensitive drum 61 and is different from the second axis X2 of the developing roller 73, the developing roller 73 moves closer to or away from the photosensitive drum 61.

<Structure of Pressing Mechanism>

As depicted in FIG. 4, a rear portion of the discharge tray 23 of the top cover 21 is provided with a bent portion 24 having a cross-sectional shape of a letter "L." The bent portion 24 has high rigidity. The bent portion 24 having high rigidity is provided with a pressing mechanism, e.g., a pressing member 9, configured to press the developing cartridge 7 such that the peripheral surface of the developing roller 73 of the developing cartridge 7 may be pressed against the peripheral surface of the photosensitive drum 61 of the photosensitive body cartridge 6.

The pressing member 9 includes a presser 91 configured to move vertically when the top cover 21 is closed, a coil spring 92 configured to bias the presser 91 downward, and a supporting cylinder 93 that movably supports the presser 91 while supporting an end of the coil spring 92. The pressing member 9 is disposed in each side of the top cover 21 in the right-left direction to press a pressed portion, e.g., the pressed surface 72A, of a corresponding one of the left and right grips 72 and 72 of the developing cartridge 7 as depicted in FIG. 3.

The left and right pressing members 9 and 9 and the left and right grips 72 and 72 are disposed on each side of an optical path of the laser beam L in a main scanning direction, as depicted in FIG. 2, to prevent the left and right pressing members 9 and 9 and the left and right grips 72 and 72 from becoming obstacles to the laser beam L emitted from the scanner unit 4 as depicted in FIG. 1.

As depicted in FIG. 1, each of the pressers 91 of the pressing members 9 is configured to press a corresponding grip 72 of the developing cartridge 7 down in a direction perpendicular to the third axis X3 connecting the right and left boss portions 74, at a position away from a corresponding boss portion 74 of the developing cartridge 7 toward the front. Consequently, the developing cartridge 7 pivotally moves clockwise about the third axis X3 connecting the right and left boss portions 74. Accordingly, the peripheral surface of the developing roller 73 is pressed against the peripheral surface of the photosensitive drum 61.

In this case, when viewed from the second axis X2 of the developing roller 73, a line L1 connecting one of the boss portions 74 and a tip of a corresponding presser 91 of the pressing member 9 is substantially perpendicular to a direction in which the tip of the presser 91 presses the corresponding grip 72. Therefore, pressing forces of the pressers 91 of the pressing members 9 are transmitted efficiently to the developing cartridge 7 as pivotal or rotational moment for pivoting the developing cartridge 7. In the illustrative embodiment, an angle formed between the line L1 and a direction in which the presser 91 presses the corresponding grip 72 may be between 85 and 95 degrees, inclusive.

In the laser printer 1 as structured above, when the top cover 21 is in an open position in which the opening A of the main casing 2 is uncovered, as depicted in FIGS. 2 and 4, the developing cartridge 7 is pushed or inserted diagonally downward and to the rear along the insertion/removal path B through the opening A of the main casing 2. At this time, the shaft supporting portions 73A of the developing roller 73 of the developing cartridge 7 are guided by the respective shaft guides 65B of the guide plates 65A provided in the photosensitive body frame 65 of the photosensitive body cartridge 6, and the boss portions 74 of the developing cartridge 7 are guided by the respective guide portions 65C of the guide plates 65A. Accordingly, the developing cartridge 7 is linearly pushed or inserted to the intermediate position (as an example of a first position) as depicted in FIG. 5, without changing its orientation.

As depicted in FIG. 1, a front half portion of the waste developer container 64 of the photosensitive body cartridge 6 is positioned on a parallel line L2, which is parallel to the guide portion 65C of the guide plate 65A and passes through the second axis X2 which is the rotation axis of the developing roller 73, when viewed from a direction of the second axis X2. At least a portion of the waste developer container 64 is positioned within a plane of projection when the developing cartridge 7 with the rotation shaft 73B guided by the guide portions 65C is projected in a direction in which the guide portions 65C extend. Therefore, when the developing cartridge 7 is linearly pushed or inserted from a position as depicted in FIG. 4 to a position as depicted in FIG. 5, a front half portion of the waste developer container 64 is disposed in front of the grips 72 and 72 of the developing cartridge 7 and becomes an obstacle to the grips 72 and 72.

Figure 5:
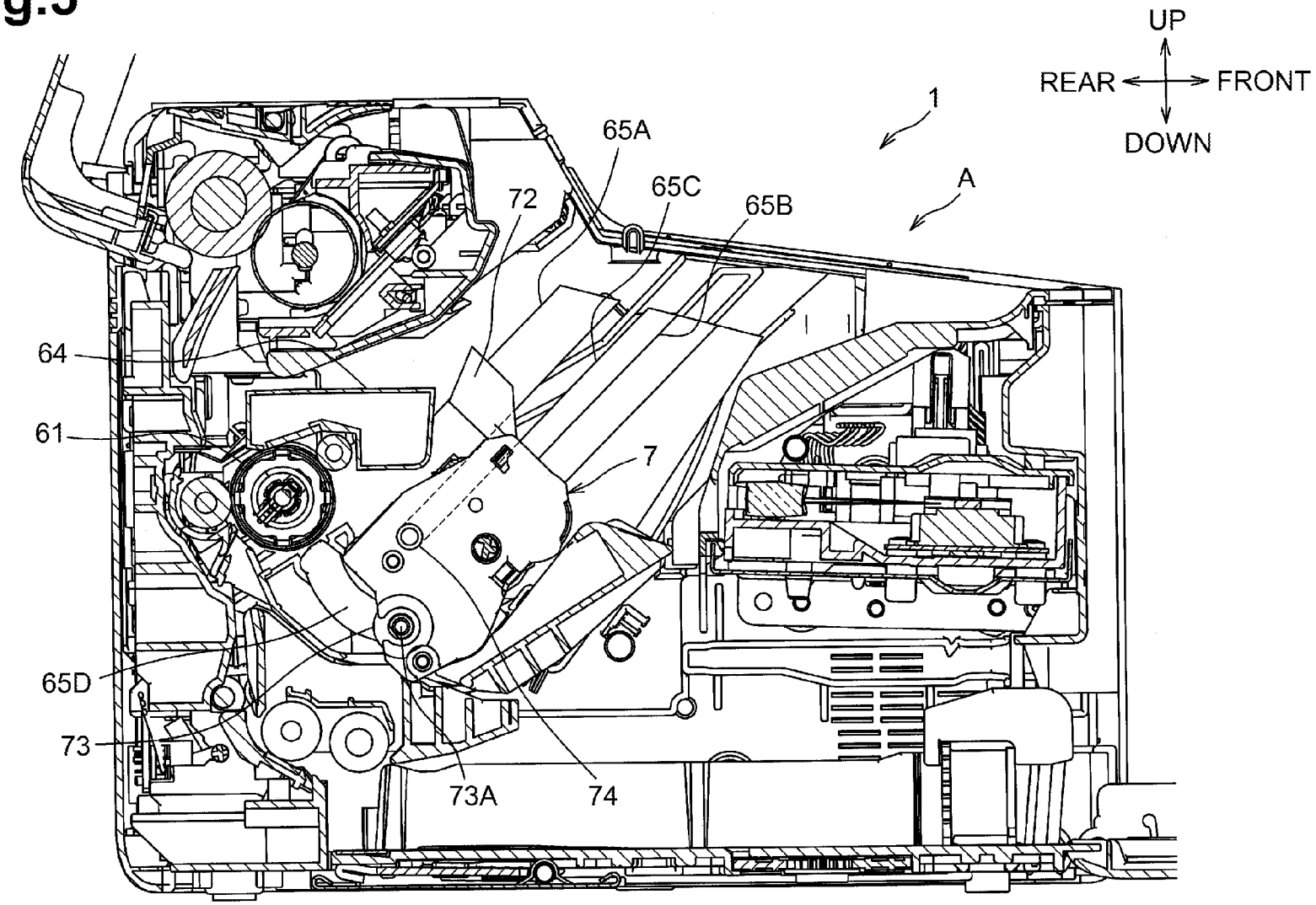
FIG. 5 is a side sectional view of the laser printer when the developing cartridge is in an intermediate position at a lower rear portion of the insertion/removal path.
Figure 6:
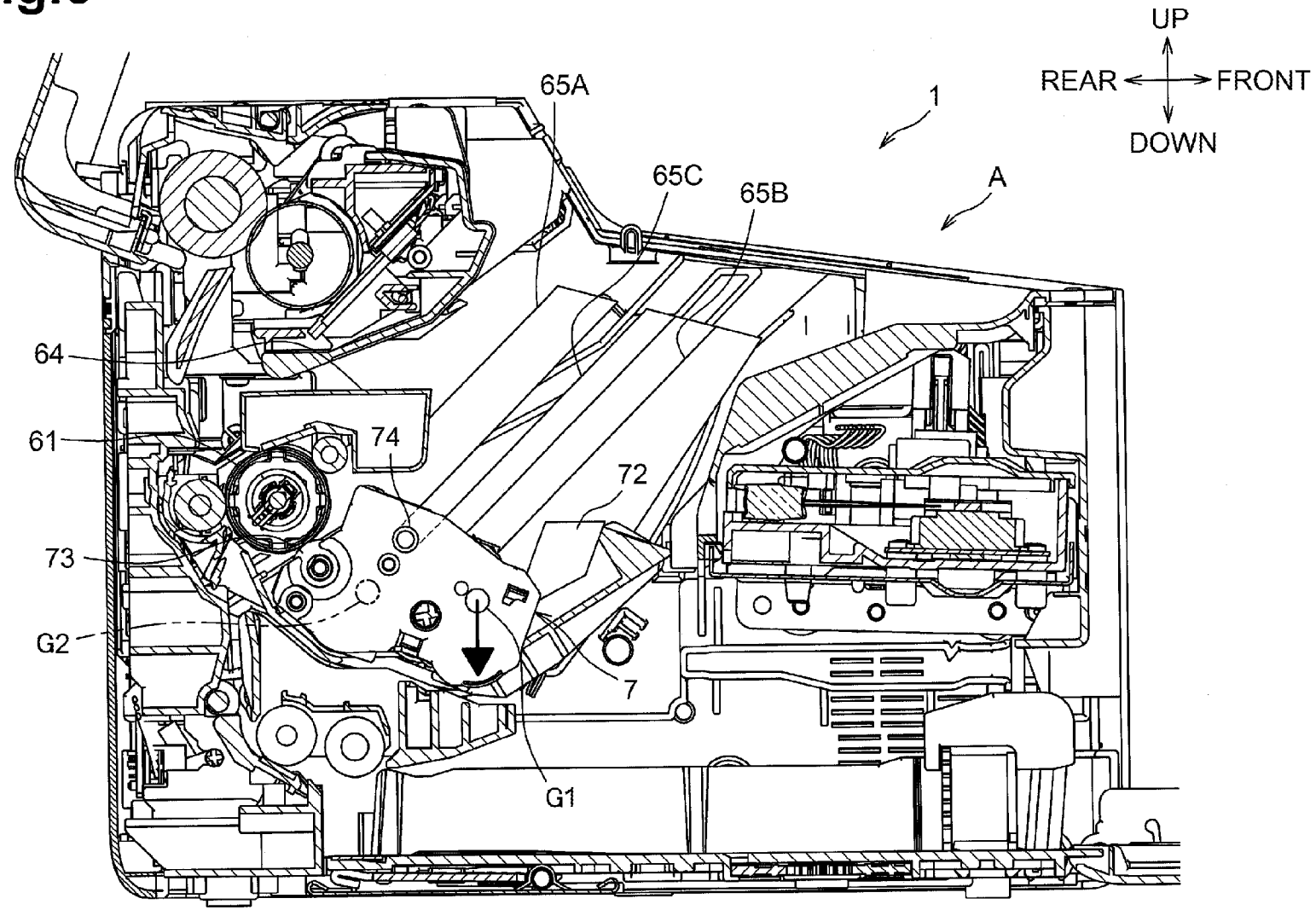
FIG. 6 is a side sectional view of the laser printer when the developing cartridge is in a mounted position at a rearmost portion of the insertion/removal path.

When the developing cartridge 7 is in a position as depicted in FIG. 5, the boss portions 74 of the developing cartridge 7 are positioned at the lower end of the respective guide portions 65C and the shaft supporting portions 73A of the developing roller 73 are positioned at front portions of the respective pivotal guides 65D. Therefore, as the developing cartridge 7 pivotally moves clockwise about the third axis X3 connecting the right and left boss portions 74, the orientation of the developing cartridge 7 is changed as depicted in FIG. 6. In other words, the orientation of the developing cartridge 7 is changed such that the developing roller 73 approaches the photosensitive drum 61. Consequently, the peripheral surface of the developing roller 73 contacts the peripheral surface of the photosensitive drum 61 and the grips 72 pivotally move forwardly away from a front half portion of the waste developer container 64.

In a state in which the developing cartridge 7 is mounted to the photosensitive body cartridge 6 and is placed in the mounted position (as an example of a second position) for printing as depicted in FIG. 6, when a center of gravity G1 of the developing cartridge 7 is in a circle indicated by a solid line in FIG. 6, the boss portions 74 of the developing cartridge 7 are positioned closer to the developing roller 73 than a vertical plane including the center of gravity G1. In this case, the developing cartridge 7 pivotally moves clockwise, while changing its orientation, about the third axis X3 connecting the right and left boss portions 74 from a position as depicted in FIG. 5 to the mounted position as depicted in depicted in FIG. 6, due to the gravity acting on the center of gravity G1. Therefore, when the center of gravity G1 of the developing cartridge 7 is in a circle indicated by the solid line in FIG. 6, the developing cartridge 7 may be readily mounted to the photosensitive body cartridge 6.

When a center of gravity G2 of the developing cartridge 7 is in a circle indicated by a chain double-dashed line in FIG. 6, the boss portions 74 of the developing cartridge 7 are positioned farther from the developing roller 73 than a vertical plane including the center of gravity G2. In this case, the developing cartridge 7 pivotally moves counterclockwise, while changing its orientation, about the third axis X3 connecting the right and left boss portions 74 from the mounted position as depicted in FIG. 6 to a position as depicted in FIG. 7, due to the gravity acting on the center of gravity G2.

Figure 7:
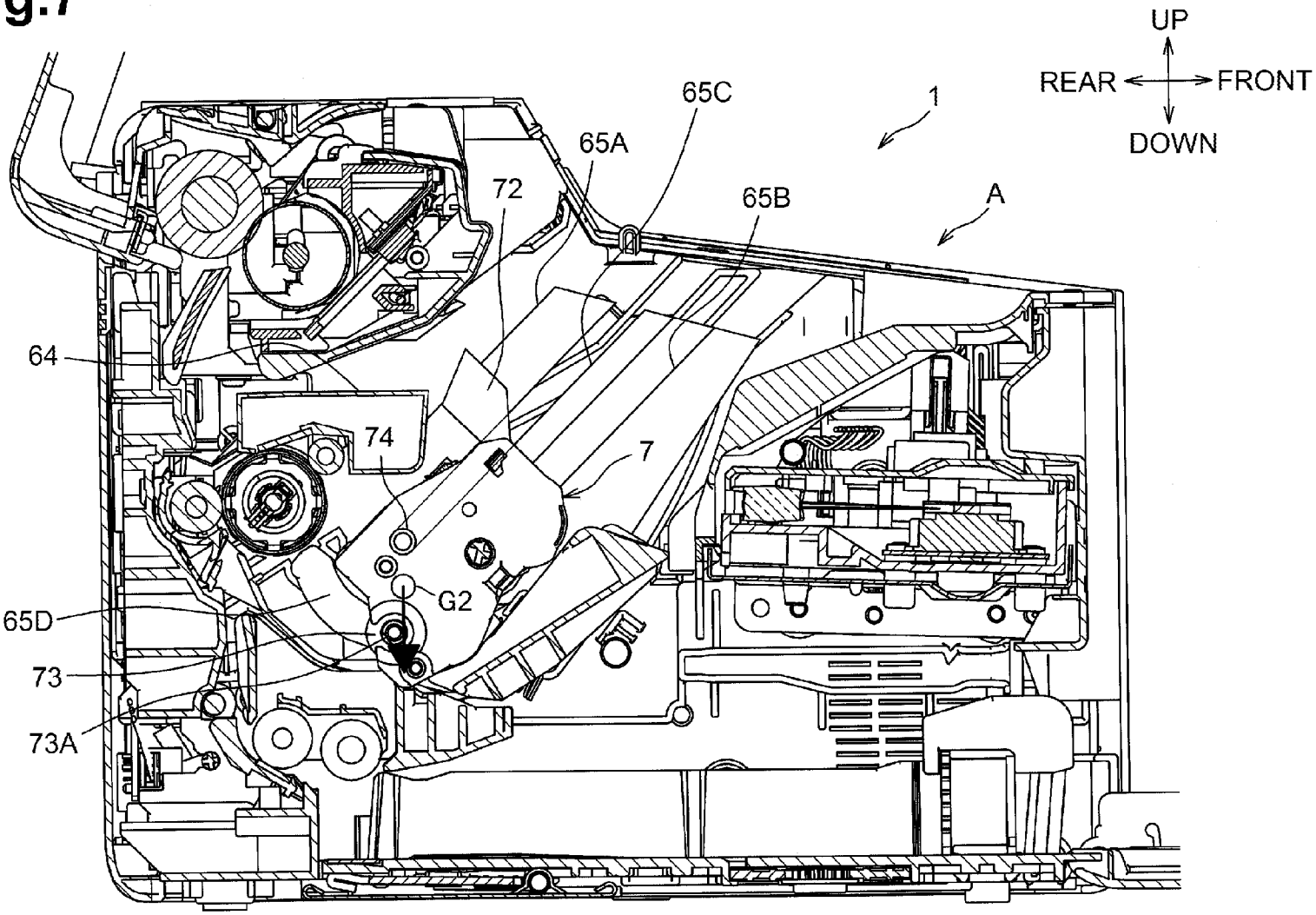
FIG. 7 is a side sectional view of the laser printer when the developing cartridge is in an intermediate position at a lower rear portion of the insertion/removal path, illustrating the center of gravity of the developing cartridge disposed near a developing roller.

The developing cartridge 7 moved, while changing its orientation, to the position as depicted in FIG. 7 is pulled linearly diagonally upward and to the front along the insertion/removal path B to the position depicted in FIG. 4, so that the developing cartridge 7 is removed through the opening A of the main casing 2. Therefore, when the center of gravity G2 of the developing cartridge 7 is in a circle indicated by the chain double-dashed line in FIG. 6, the developing cartridge 7 may be readily removed through the main casing 2.

In the laser printer 1 according to the illustrative embodiment, the developing cartridge 7 is configured to pivotally move relative to the main casing 2 about the third axis X3 connecting the right and left boss portions 74. When the developing cartridge 7 is mounted to or removed from the photosensitive body frame 65 of the photosensitive body cartridge 6 through the opening A of the main casing 2 with the top cover 21 opened, the developing cartridge 7 is pivotally moved about the third axis X3 relative to the main casing 2, to change an orientation thereof. Accordingly, even when there is an obstacle on the insertion/removal path B of the developing cartridge 7, the developing cartridge 7 may be mounted or removed while avoiding the obstacle. The pressing members 9 configured to press the developing cartridge 7 are provided at the top cover 21. Therefore, the developing cartridge 7 may be smoothly mounted in place.

As the top cover 21 is closed, as depicted in FIG. 1, with the developing cartridge 7 in the mounted position as depicted in FIG. 6, each of the pressers 91 of the left and right pressing members 9 provided at an inner surface of the discharge tray 23 of the top cover 21 presses a corresponding pressed portion, e.g., the left or right grips 72 or 72, provided at the developing cartridge 7. Accordingly, the developing cartridge 7 pivotally moves clockwise about the third axis X3 connecting the right and left boss portions 74, so that the peripheral surface of the developing roller 73 is pressed against the peripheral surface of the photosensitive drum 61.

When the peripheral surface of the developing roller 73 is thus pressed against the peripheral surface of the photosensitive drum 61, the developing roller 73 having a higher peripheral speed than the photosensitive drum 61 tends to climb up along the peripheral surface of the photosensitive drum 61 and move in a direction of the common tangent L3 of the photosensitive drum 61 and the developing roller 73. The regulating surface E1 of the regulating portion 65E is perpendicular to the direction of the common tangent L3 of the photosensitive drum 61 and the developing roller 73. Therefore, as the shaft supporting portions 73A of the developing roller 73 contact the respective regulating portions 65E, the developing roller 73 is prevented from moving in the direction of the common tangent L3 of the photosensitive drum 61 and the developing roller 73.

[First Variation]

In the disclosure, an image forming apparatus, e.g., the laser printer 1, according to an illustrative embodiment is described. The image forming apparatus of the disclosure is not limited to the laser printer 1 according to an illustrative embodiment. In another embodiment, structures of the laser printer 1 may be changed as necessary. For example, as depicted in FIG. 8, a holding member, e.g., a holding spring 66, may be provided at a lower portion of each guide portion 65C configured to guide a corresponding boss portion 74 of the developing cartridge 7. The holding spring 66 is configured to hold the boss portion 74 at a lower end portion (e.g., a supporting position) of the guide portion 65C. The holding spring 66 may protrude toward an interior space of the guide portion 65C.

[Second Variation]

Figure 9:
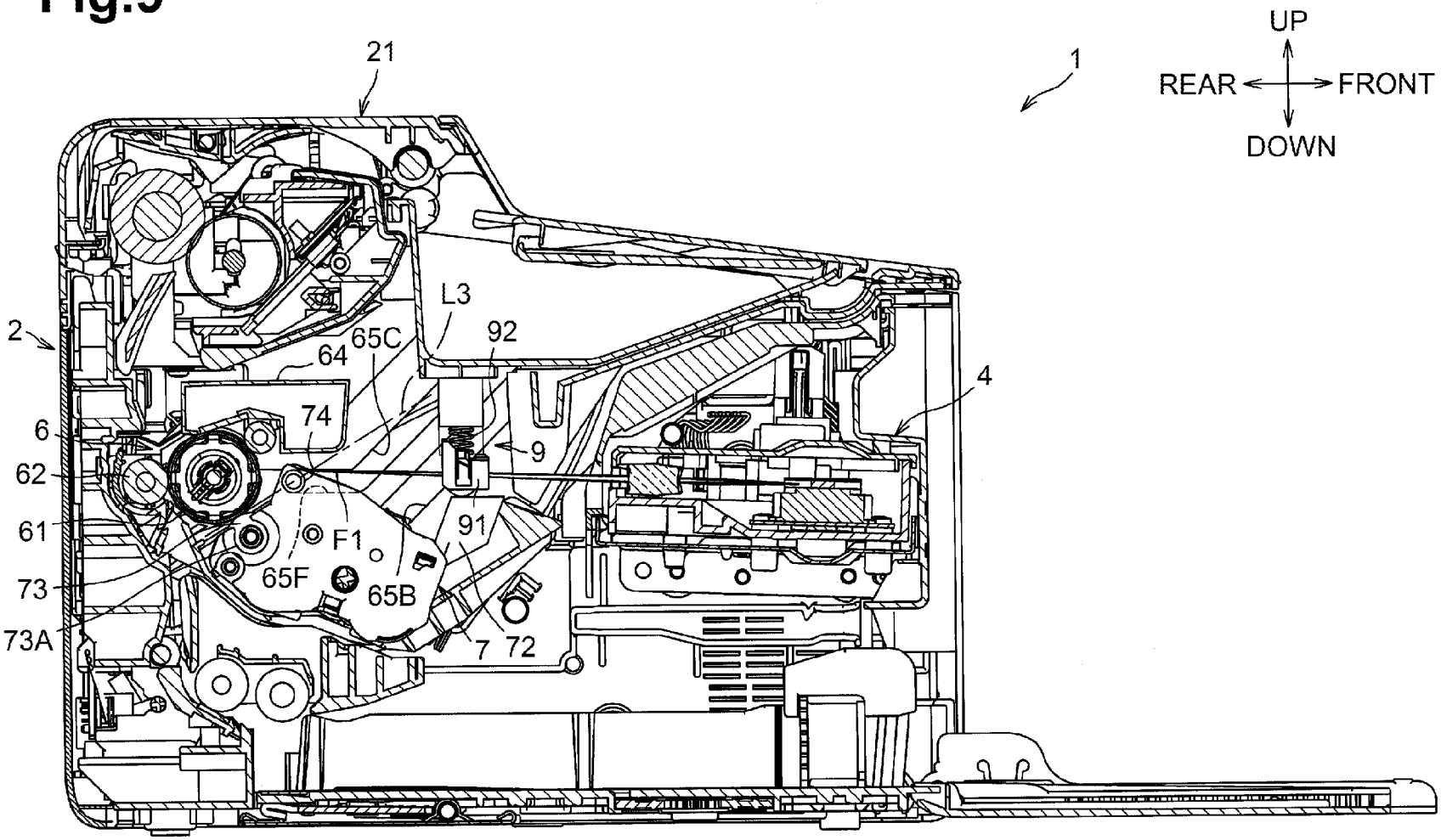
FIG. 9 is a side sectional view of a second modification of the laser printer depicted in FIG. 1, illustrating a general structure of the modified laser printer with a top cover thereof closed.

As depicted in FIG. 9, each guide portion 65C configured to guide a corresponding boss portion 74 of the developing cartridge 7 may include a horizontal portion 65F that may be provided by bending a lower end portion of the guide portion 65C substantially horizontally to extend rearward. A position of each boss portion 74 may be changed such that the boss portion 74 may be positioned on the common tangent L3 of the photosensitive drum 61 and the developing roller 73 and at a rear end portion of a corresponding horizontal portion 65F when the developing cartridge 7 is in the mounted position in which the developing roller 73 is pressed against the photosensitive drum 61. An upper surface F1 of the horizontal portion 65F corresponds to an intersecting surface extending in a direction intersecting with the direction of the common tangent L3.

In this case, as each boss portion 74 of the developing cartridge 7 contacts the upper surface F1 of the horizontal portion 65F of a corresponding guide plate 65A, the developing roller 73 is prevented from moving in the direction of the common tangent L3 of the photosensitive drum 61 and the developing roller 73. As the boss portions 74 are on the common tangent L3, the developing cartridge 7 may be prevented from being pivotally moved about the boss portions 74 by force acting in the direction of the common tangent L3.

Further, the developing cartridge 7 is configured to be mounted to and removed from the main casing 2 indirectly via the photosensitive body cartridge 60. In another embodiment, the developing cartridge 7 may be configured to be mounted to and removed from the main casing 2 directly, by providing such guide plates 65A provided in the photosensitive body cartridge 6, in the main casing 2.

[Third Variation]

Figure 10A:
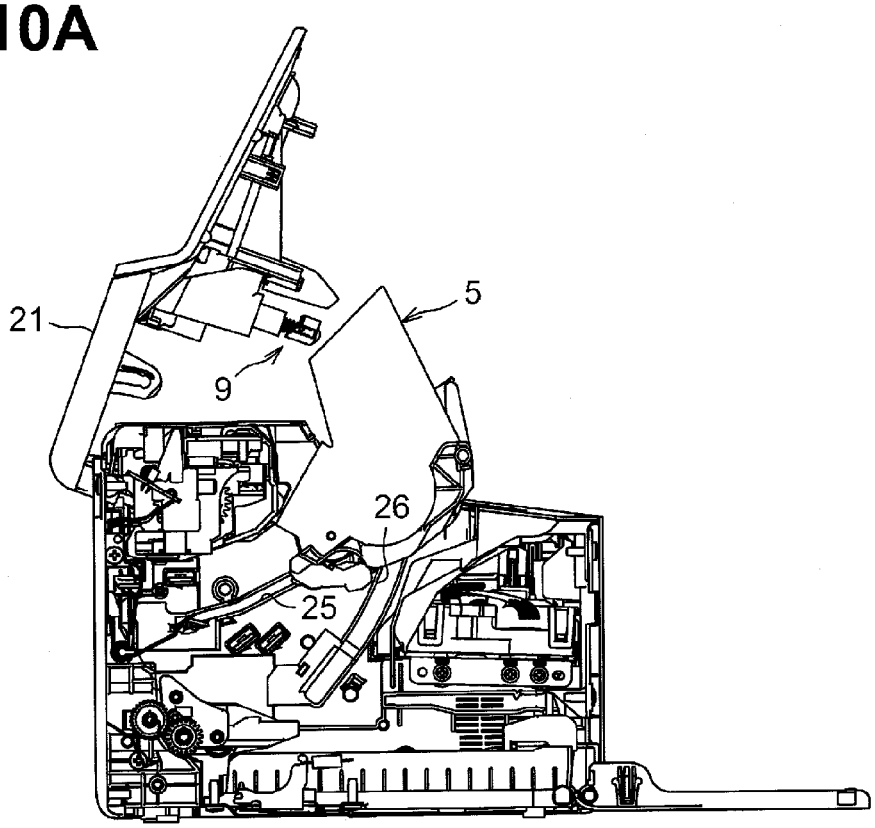
FIG. 10A is a side sectional view of a third modification of the laser printer depicted in FIG. 1, illustrating a process cartridge is in a removed position on the insertion/removal path.
Figure 10B:
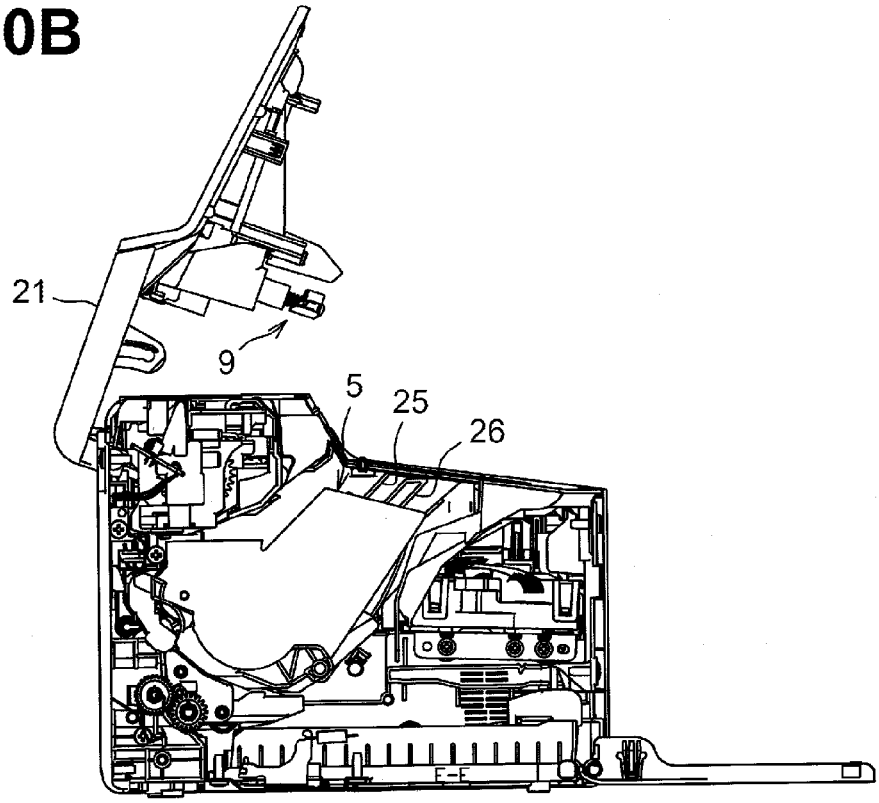
FIG. 10B is a side sectional view of the third modification of the laser printer, illustrating the process cartridge is in a mounted position on the insertion/removal path.

The photosensitive body cartridge 6 may be configured to be mounted to and removed from the main casing 2. In this case, guides 25 and 26 may be provided at an inner surface of each of right and left side walls of the main casing 2 to guide the process cartridge 5 having the developing cartridge 7 mounted to the photosensitive body cartridge 6 between a removed position as depicted in FIG. 10A and the mounted position as depicted in FIG. 10B.

A contact portion between each of the pressers 91 of the pressing members 9 and a corresponding grip 72 of the developing cartridge 7 as depicted in FIG. 1 in the top-bottom direction may be changed as necessary.

The developing cartridge 7 may be changed to a developing sleeve in which a magnet roller is disposed therein, instead of the developing roller 73.

The waste developer container 64 may be configured to contain waste developer adhered to the charging roller 63. The grips 72 of the developing cartridge 7 may be integrally formed with the developing frame 71 or separately formed.

In the above-described illustrative embodiment, each boss portion 74 (e.g., a supported portion), which is a pivot point of the developing cartridge 7, and each shaft supporting portion 73A supporting the rotation shaft 73B of the developing roller 73 are guided. However, the disclosure is not limited thereto. In another embodiment, for example, a boss with its center being an axis different from the second axis X2 and the third axis X3, may be guided.

In the above-described illustrative embodiment, the shaft guides 65B are provided in the photosensitive body cartridge 6. However, the disclosure is not limited thereto. For example, a shaft guide may be provided in a main body of an image forming apparatus other than a photosensitive body cartridge.

While the disclosure has been described in detail referring to the specific embodiment thereof, this is merely an example, and various changes, arrangements and modifications may be applied therein without departing from the spirit and scope of the disclosure.

What is claimed is:

1. An image forming apparatus comprising:

a main body having an opening;

a cover configured to open and close the opening;

a photosensitive body cartridge including a photosensitive body configured to rotate about a first axis;

a developing cartridge including a developer carrier configured to rotate about a second axis parallel to the first axis and to supply developer to the photosensitive body, the main body being configured to receive the developing cartridge through the opening in a direction perpendicular to the first axis, wherein the developing cartridge is separate from the photosensitive body cartridge, and wherein the developing cartridge further comprises a boss portion that has a third axis;

a supporting portion configured to support the boss portion, wherein the supporting portion and the boss portion are configured such that the developing cartridge is pivotable relative to the main body about the third axis using the boss portion, which is parallel to the first axis and is separate from the second axis, between a first position, in which the developer carrier is away from the photosensitive body, and a second position, in which the developer carrier is close to the photosensitive body, and wherein the cover includes a pressing member configured to press the developing cartridge in a direction perpendicular to the third axis such that the developing cartridge pivots about the third axis using the boss portion from the first position to the second position.

2. The image forming apparatus according to claim 1, wherein when the developing cartridge is located in the second position, the developing cartridge is capable of supplying the developer to the photosensitive body.

3. The image forming apparatus according to claim 1, wherein the third axis passes through a center of the boss portion.

4. The image forming apparatus according to claim 3, further comprising a guide portion configured to guide the boss portion to a position in which the developing cartridge is disposed in the first position.

5. The image forming apparatus according to claim 4, further comprising a regulating portion configured to regulate movement of the developing cartridge in a direction of a common tangent of the photosensitive body and the developer carrier.

6. The image forming apparatus according to claim 5, wherein the developing cartridge includes a protrusion with a center thereof being the second axis, and the protrusion protrudes along the second axis, and wherein the regulating portion is configured to contact the protrusion.

7. The image forming apparatus according to claim 6, wherein the regulating portion includes a surface which is perpendicular to the direction of the common tangent.

8. The image forming apparatus according to claim 4, further comprising a holding member configured to hold the boss portion at the supporting position.

9. The image forming apparatus according to claim 5, wherein the guide portion includes an intersecting surface extending in a direction intersecting with the direction of the common tangent, and wherein the regulating portion includes the intersecting surface.

10. The image forming apparatus according to claim 9, wherein the boss portion is positioned on the common tangent.

11. The image forming apparatus according to claim 4, wherein the boss portion is positioned closer to the developer carrier than a vertical plane including a center of gravity of the developing cartridge.

12. The image forming apparatus according to claim 4, wherein the boss portion is positioned farther from the developer carrier than a vertical plane including a center of gravity of the developing cartridge.

13. The image forming apparatus according to claim 1, further comprising an exposure device configured to expose a surface of the photosensitive body to laser beam, and wherein the pressing member is disposed on each side with respect to an optical path of the laser beam in a main scanning direction.

14. The image forming apparatus according to claim 1, further comprising an exposure device configured to expose a surface of the photosensitive body to laser beam, and wherein the developing cartridge includes a pressed portion disposed on each side thereof with respect to an optical path of the laser beam in a main scanning direction, and is pressed by the pressing member.

15. The image forming apparatus according to claim 14, wherein the pressed portion includes a grip provided at the developing cartridge.

16. The image forming apparatus according to claim 1, wherein the cover includes a discharge tray including a bent portion having a cross-sectional shape of a letter "L", and wherein the pressing member is disposed at the bent portion of the discharge tray.

17. The image forming apparatus according to claim 4, wherein when viewed from an axial direction of the developer carrier, a line connecting the boss portion and a pressing portion of the pressing member is substantially perpendicular to a pressing direction of the pressing member.

18. The image forming apparatus according to claim 1, further comprising a shaft guide configured to guide a rotation shaft of the developer carrier.

19. The image forming apparatus according to claim 18, wherein the photosensitive body cartridge includes the shaft guide.

20. The image forming apparatus according to claim 4, wherein the photosensitive body cartridge includes the guide portion.

21. The image forming apparatus according to claim 1, further comprising a fixing portion disposed above the photosensitive body such that a C-shaped feeding path is defined in the main body.

22. The image forming apparatus according to claim 4, further comprising a waste developer container configured to contain the developer collected from the photosensitive body, and wherein a portion of the waste developer container is disposed on a line, which is parallel to the guide portion and passes through the second axis, when viewed from a direction of the second axis.

23. The image forming apparatus according to claim 4, wherein the boss portion is configured to electrically connect to the developer carrier.

24. The image forming apparatus according to claim 1, wherein the photosensitive body cartridge includes the supported portion.

* * * * *